US009158265B2

(12) United States Patent
Minami

(10) Patent No.: US 9,158,265 B2
(45) Date of Patent: Oct. 13, 2015

(54) HIGH-VOLTAGE POWER SOURCE, CHARGING DEVICE INCORPORATING SAME, AND HIGH-VOLTAGE POWER SUPPLYING METHOD

(71) Applicant: Shinji Minami, Kanagawa (JP)

(72) Inventor: Shinji Minami, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/500,892

(22) Filed: Sep. 29, 2014

(65) Prior Publication Data

US 2015/0093137 A1 Apr. 2, 2015

(30) Foreign Application Priority Data

Oct. 1, 2013 (JP) ..... 2013-206131
Mar. 12, 2014 (JP) ..... 2014-048455

(51) Int. Cl.
*G03G 15/00* (2006.01)
*G03G 15/02* (2006.01)

(52) U.S. Cl.
CPC ..... *G03G 15/80* (2013.01); *G03G 15/0266* (2013.01)

(58) Field of Classification Search
CPC ..... G03G 15/80; G03G 15/0266
USPC ..... 399/89
See application file for complete search history.

(56) References Cited

FOREIGN PATENT DOCUMENTS

JP 2011-008033 1/2011
JP 2011-215650 10/2011

*Primary Examiner* — David Bolduc
*Assistant Examiner* — Barnabas Fekete
(74) *Attorney, Agent, or Firm* — Duft Bornsen & Fettig LLP

(57) ABSTRACT

A high-voltage power source includes a high-voltage power source unit configured to apply high voltage obtained by superposing a high alternating-current voltage on a high direct-current voltage to a charging member, an output unit configured to output a first direct-current voltage having a first voltage value according to an externally input pulse-width modulation signal, a direct-current voltage conversion unit configured to convert the first direct-current voltage into a second direct-current voltage, a generation unit configured to boost the second direct-current voltage to generate a high direct-current voltage, a peak value detection unit configured to detect a positive peak value and a negative peak value from an alternating-current component of the high direct-current voltage, and a voltage difference output unit configured to output a third direct-current voltage having a third voltage value to the direct-current voltage conversion unit.

14 Claims, 14 Drawing Sheets

HIGH-VOLTAGE POWER SOURCE, CHARGING DEVICE INCORPORATING SAME, AND HIGH-VOLTAGE POWER SUPPLYING METHOD

CROSS-REFERENCE TO RELATED APPLICATIONS

This patent application is based on and claims priority pursuant to 35 U.S.C. §119(a) to Japanese Patent Application Nos. 2013-206131 and 2014-048455, filed on Oct. 1, 2013, and Mar. 12, 2014, respectively, in the Japan Patent Office, the entire disclosure of which is hereby incorporated by reference herein.

BACKGROUND

1. Technical Field

Example embodiments of the present invention generally relate to a high-voltage power source, a charging device incorporating that high-voltage power source, and a high-voltage power supplying method.

2. Background Art

In electrophotographic image forming apparatuses, the surface of a photoreceptor needs to be charged so as to have a desired electrical potential, for the formation of an image of good quality. In this respect, a method of applying high voltage to a charging roller that charges a photoreceptor is known. In this method, the high voltage applied to the charging roller is a voltage on which a direct-current voltage and a sinusoidal alternating-current voltage are superposed. According to this method, the electric discharge on the positive side and the electric discharge on the negative side occur in an alternate manner between the charging roller and the photoreceptor, and the surface of the photoreceptor is evenly charged so as to have a desired electrical potential.

In recent years, there are some cases in which discharging processes of a photoreceptor after the first transfer process are omitted to reduce the cost. In such cases, the photoreceptor is charged due to the first transfer bias, and the electric charge remains on the photoreceptor. Such remaining electric charge interrupts a stable discharge between the surface of the photoreceptor and the charging roller, and the surface potential of the photoreceptor deviates from a desired level. Accordingly, the quality of the formed image deteriorates.

SUMMARY

Embodiments of the present invention described herein provide a high-voltage power source, a charging device incorporating the same, and a high-voltage power supplying method. The high-voltage power source includes a high-voltage power source unit configured to apply high voltage obtained by superposing a high alternating-current voltage on a high direct-current voltage to a charging member used to charge a photoreceptor of an image forming apparatus, an output unit configured to output a first direct-current voltage having a first voltage value according to an externally input pulse-width modulation signal, a direct-current voltage conversion unit configured to convert the first direct-current voltage into a second direct-current voltage, a generation unit configured to boost the second direct-current voltage to generate a high direct-current voltage, a peak value detection unit configured to detect a positive peak value and a negative peak value from an alternating-current component of the high direct-current voltage, and a voltage difference output unit configured to calculate a third voltage value by multiplying a difference between an absolute value of the positive peak value and an absolute value of the negative peak value by a coefficient $\alpha$, and output a third direct-current voltage having the third voltage value to the direct-current voltage conversion unit. The coefficient $\alpha$ is a positive real number smaller than one. The direct-current voltage conversion unit outputs the second direct-current voltage having a voltage value calculated by subtracting the third voltage value from the first voltage value.

BRIEF DESCRIPTION OF THE DRAWINGS

A more complete appreciation of exemplary embodiments and the many attendant advantages thereof will be readily obtained as the same becomes better understood by reference to the following detailed description when considered in connection with the accompanying drawings.

Figure 1:
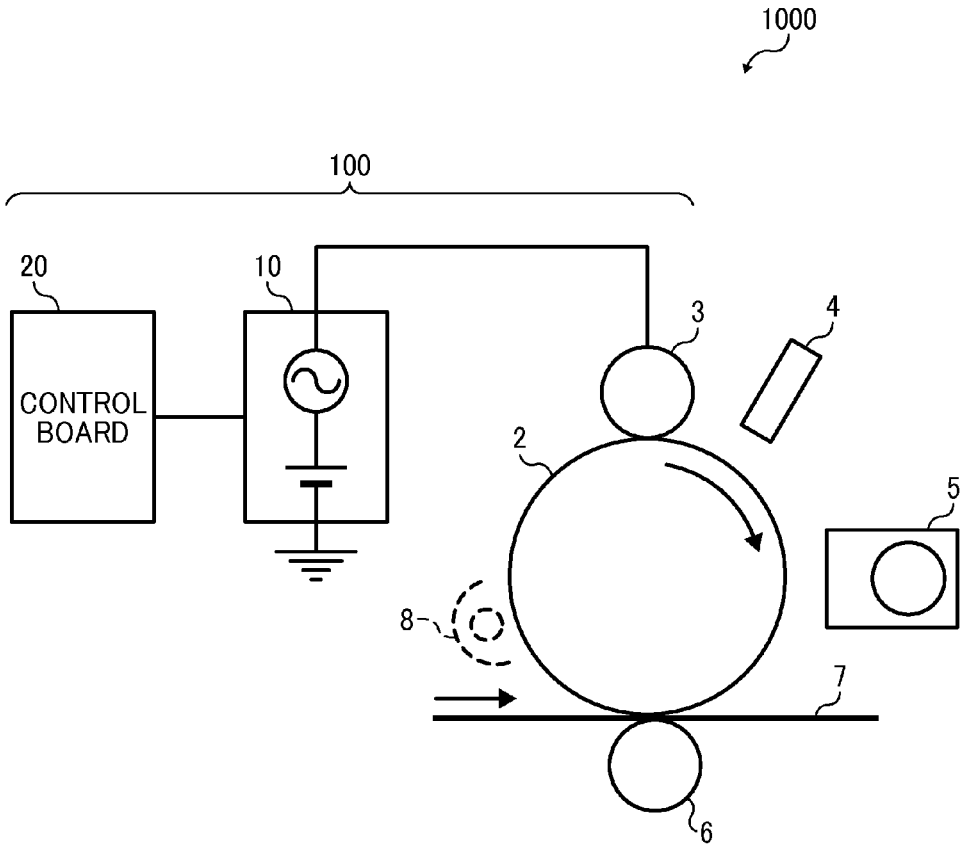
FIG. 1 is a schematic diagram illustrating the schematic configuration of an electrophotographic image forming apparatuses according to a first example embodiment of the present invention.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that have the same structure, operate in a similar manner, and achieve a similar result.

Some embodiments of the present invention will be described, but various applications and modifications may be made without departing from the scope of the invention. In the drawings, like reference signs are given to common elements, and the description may be omitted where appropriate.

First Embodiment

FIG. 1 is a schematic diagram illustrating the schematic configuration of an electrophotographic image forming apparatuses 1000 according to an example embodiment of the present invention. In FIG. 1, for the purpose of simplification, the image forming apparatuses 1000 includes only a high-voltage power source 10, a control board 20, a photoreceptor 2, a charging roller 3, an exposure device 4, a development device 5, a first transfer unit 6, and an intermediate transfer belt 7. The high-voltage power source 10, the control board 20, and the charging roller 3 together configure a charging device 100 according to the present example embodiment.

In the charging device 100 according to the present example embodiment, the high-voltage power source 10 generates high voltage by superposing a high direct-current voltage on a high alternating-current voltage, and applies the generated high voltage to the charging roller 3. As the photoreceptor 2 and the charging roller 3 are in contact with each other or close to each other with the distance of tens of microns, electric discharge occurs between the surface of the photoreceptor 2 and the surface of the charging roller 3 due to the application of high voltage. As a result, the surface of the photoreceptor 2 is charged so as to have a desired electrical potential.

The photoreceptor 2 that has been charged to have the desired potential is then exposed by the exposure device 4 in accordance with an image signal, and an electrostatic latent image is formed on the photoreceptor 2 accordingly. The electrostatic latent image formed on the photoreceptor 2 is developed by the development device 5, and becomes a toner image. The toner image is then transferred to the intermediate transfer belt 7 by the first transfer unit 6. Then, the toner image transferred to the intermediate transfer belt 7 is transferred to a print medium by the second transfer unit, and is fixed by a fixing unit. Accordingly, an image is formed.

Figure 2:
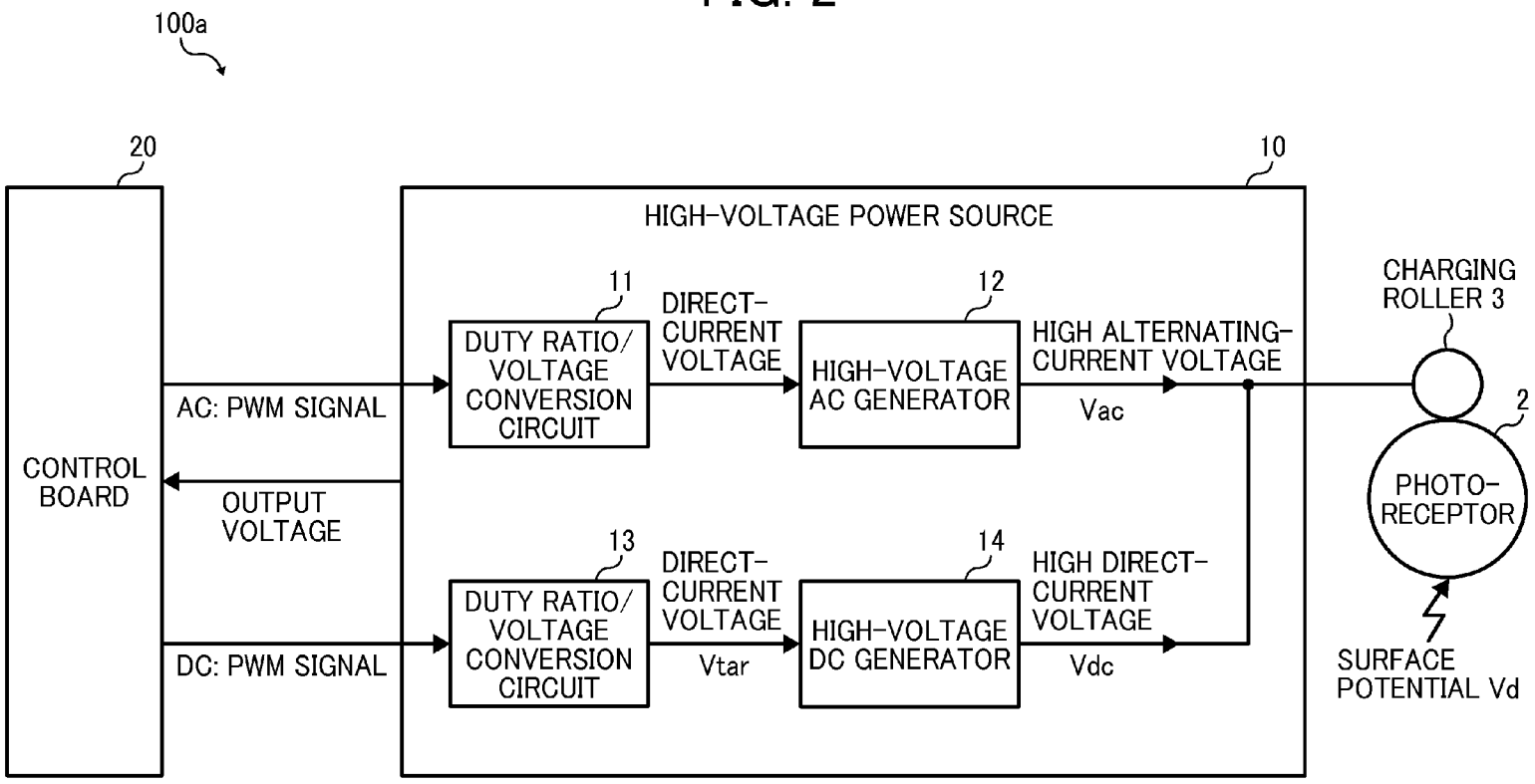
FIG. 2 is a schematic diagram illustrating the basic configuration of a charging device according to a first example embodiment of the present invention.

FIG. 2 schematically illustrates the basic configuration of a charging device 100*a* according to the first example embodiment of the present invention. In FIG. 2, only general elements are illustrated for the purpose of simplification. Basic elements of a mechanism for controlling the surface potential of the photoreceptor 2 are described below with reference to FIG. 2.

In the charging device 100*a* according to the present example embodiment, when high voltage obtained by superposing the high alternating-current voltage Vac output from a high-voltage alternating current (AC) generator 12 on the high direct-current voltage Vdc output from a high-voltage direct current (DC) generator 14 is applied to the charging roller 3, electric discharge occurs between the charging roller 3 and the photoreceptor 2, and the surface of the photoreceptor 2 is charged. In so doing, the surface potential Vd of the photoreceptor 2 is controlled by the voltage value of the high direct-current voltage Vdc, and the voltage value of the high direct-current voltage Vdc is controlled by the duty ratio of the pulse-width modulation signal sent from the control board 20.

The control board 20 generates a pulse-width modulation signal used for determining the voltage value of the direct-current voltage, and transmits the generated pulse-width modulation signal to the high-voltage power source 10. Note that this pulse-width modulation signal later becomes the source of high alternating-current voltage Vac. Hereinafter, the pulse-width modulation signal is referred to as an "AC: PWM signal". The AC: PWM signal transmitted from the control board 20 is input to a duty ratio/voltage conversion circuit 11, which includes an integrating circuit or the like.

The duty ratio/voltage conversion circuit 11 generates direct-current voltage having the voltage value that corresponds to the duty ratio of the received AC: PWM signal, and outputs the generated direct-current voltage to a high-voltage AC generator 12.

The high-voltage AC generator 12 generates a sinusoidal high alternating-current voltage Vac based on the direct-current voltage input from the duty ratio/voltage conversion circuit 11. More specifically, the high-voltage AC generator 12 firstly converts the received direct-current voltage into a sinusoidal alternating-current voltage, and then boosts the sinusoidal alternating-current voltage at a prescribed transformation ratio and outputs the sinusoidal high alternating-current voltage Vac.

The control board 20 generates a pulse-width modulation signal used for determining the voltage of the direct-current voltage, which later becomes the source of a high direct-current voltage Vdc, and transmits the generated pulse-width modulation signal to the high-voltage power source 10. Hereinafter, this pulse-width modulation signal is referred to as a "DC: PWM signal". The DC: PWM signal transmitted from the control board 20 is input to a duty ratio/voltage conversion circuit 13, which includes an integrating circuit or the like.

The duty ratio/voltage conversion circuit 13 generates direct-current voltage having the voltage value that corresponds to the duty ratio of the received DC: PWM signal, and outputs the generated direct-current voltage to a high-voltage DC generator 14.

The high-voltage DC generator 14 generates a high direct-current voltage Vdc based on the direct-current voltage input from the duty ratio/voltage conversion circuit 13. More specifically, the high-voltage DC generator 14 firstly converts the received direct-current voltage into a sinusoidal alternating-current voltage, and then boosts the sinusoidal alternating-current voltage at a prescribed transformation ratio to generate a high alternating-current voltage, and outputs the high direct-current voltage Vdc obtained by rectifying the generated high alternating-current voltage.

In the present example embodiment, the high alternating-current voltage Vac output from the high-voltage AC generator 12 is superposed on the high direct-current voltage Vdc output from the high-voltage DC generator 14, and the obtained high voltage is applied to the charging roller 3. As a result, electric discharge occurs between the charging roller 3 and the photoreceptor 2, and the surface of the photoreceptor 2 is charged.

Figure 3:
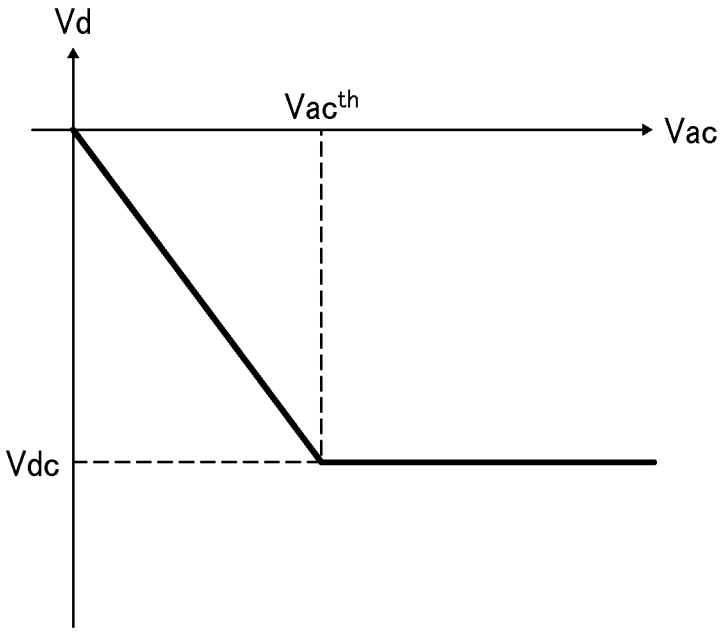
FIG. 3 illustrates the relationship between the high alternating-current voltage Vac generated by a high-voltage power source and the surface potential Vd of a photoreceptor, according to an example embodiment of the present invention.

FIG. 3 illustrates the relationship between the high alternating-current voltage Vac generated by the high-voltage power source 10 and the surface potential Vd of the photoreceptor 2, according to the present example embodiment of the present invention. In the configuration described above, the high alternating-current voltage Vac and the surface potential Vd of the photoreceptor 2 have a relationship as illustrated in FIG. 3. More specifically, as the value of the high alternating-current voltage Vac is increased while the high direct-current voltage Vdc is maintained at a constant level, the surface potential Vd of the photoreceptor 2 increases. The surface potential Vd becomes constant after the value of the high alternating-current voltage Vac exceeds a specified value $Vac^{th}$.

When the surface potential Vd becomes constant, the surface potential Vd of the photoreceptor 2 is equal to the high direct-current voltage Vdc output from the high-voltage DC generator 14. For this reason, the surface potential Vd of the photoreceptor 2 can be adjusted to a desired level by controlling the direct-current voltage that is the source of the high direct-current voltage Vdc output from the high-voltage DC generator 14.

Assuming that a desired value for the surface potential Vd of the photoreceptor 2 is "Vd_i", the control board 20 executes the following controlling processes. That is, the control board 20 refers to the current value (i.e., the current value of the current flowing between the charging roller 3 and the photoreceptor 2) fed back from the high-voltage power source 10, and controls the duty ratio of the AC: PWM signal such that the high alternating-current voltage Vac will be maintained at a specified level that is equal to or greater than $Vac^{th}$ (see FIG. 3). Concurrently, the control board 20 controls the duty ratio of the DC: PWM signal such that the high direct-current voltage Vdc will be output from the high-voltage DC generator 14 with the voltage value of Vd_i. Note that the voltage value of the direct-current voltage output from the duty ratio/voltage conversion circuit 13 is hereinafter referred to as "Vtar".

As described above, as long as discharging processes are performed after transferring processes, the surface potential Vd of the photoreceptor 2 is equal to the voltage value Vd_i of the high direct-current voltage Vdc output from the high-voltage DC generator 14. However, if a discharger 8 is not provided for the image forming apparatus 1000 at a position drawn by broken lines as illustrated in FIG. 1, the surface potential Vd of the photoreceptor 2 may fail to match the voltage value Vd_i of the high direct-current voltage Vdc output from the high-voltage DC generator 14. Such cases are described below with reference to FIG. 4.

When electric discharge occurs between the charging roller 3 and the photoreceptor 2, the waveform of the sinusoidal high alternating-current voltage Vac is distorted due to abrupt variations in load, and the amplitude becomes narrower than the original sinusoidal wave indicated by dotted lines. Because the size of the distortion depends on the amount of the charge transferred by electric discharge, bipolar discharge occurs on both the positive side and the negative side. Accordingly, the waveform of the alternating-current voltage is distorted on both the positive side and the negative side.

Figure 4A:
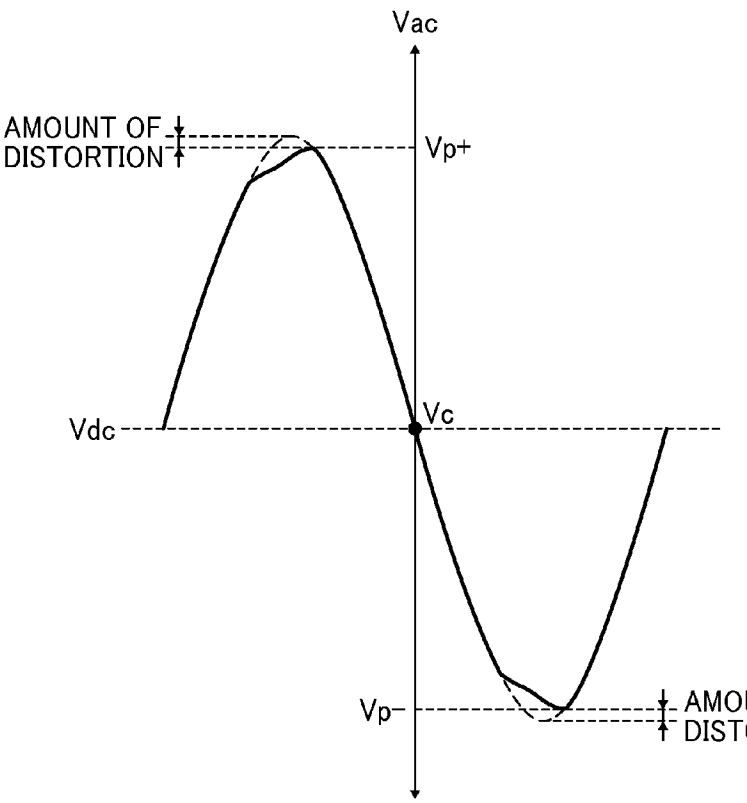
FIGS. 4A and 4B are diagrams illustrating the distortion in the waveform of high alternating-current voltage caused by electric discharge, according to an example embodiment of the present invention.
Figure 4B:
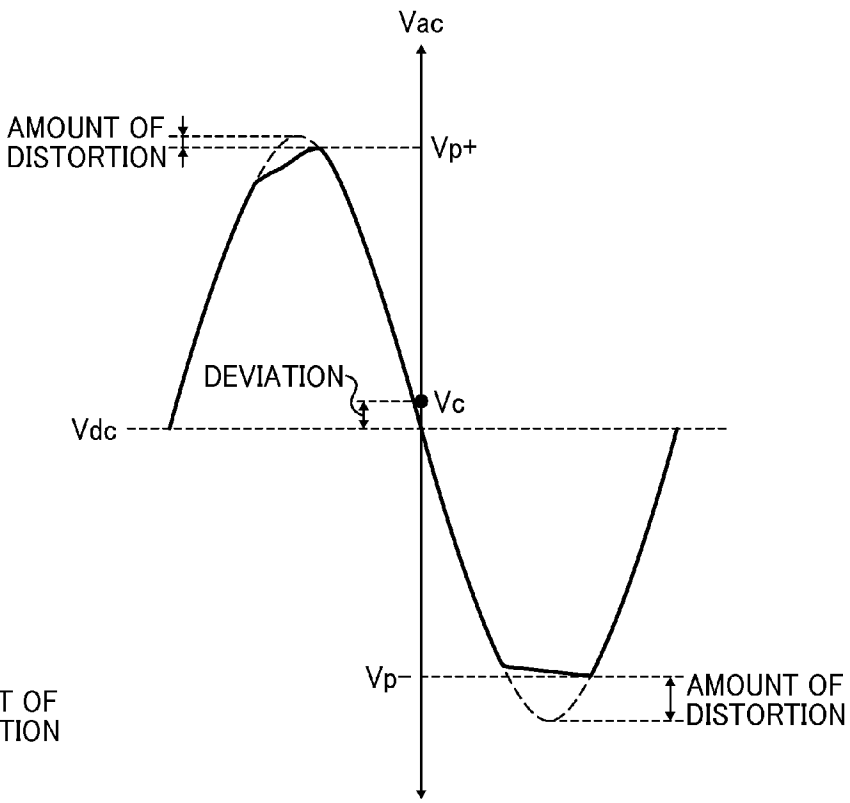

FIGS. 4A and 4B are diagrams illustrating the distortion in the waveform of high alternating-current voltage caused by electric discharge, according to an example embodiment of the present invention. When the amount of distortion in the waveform of the alternating-current voltage is equal between the positive side and the negative side, a center value Vc of the sinusoidal high alternating-current voltage Vac matches the high direct-current voltage Vdc, as illustrated in FIG. 4A.

However, in cases where discharging processes are not performed after transferring processes as in the image forming apparatus 1000 according to the present example embodiment, the charge incurred by the first transfer bias or the like is not cleared from the surface of the photoreceptor 2 before shifting to the next charging process. Accordingly, there is a difference between the amount of the charge transferred by positive electric discharge and the amount of the charge transferred by negative electric discharge.

For example, when the surface potential of the photoreceptor 2 is positively charged due to the first transfer bias, more positive electric discharge occurs than negative electric discharge in the following charging process, and the amount of the charge transferred by negative electric discharge becomes greater accordingly. As a result, the amount of distortion in the waveform of the alternating-current voltage becomes greater on the positive side than on the negative side, and a center value Vc of the sinusoidal high alternating-current voltage Vac deviates from the high direct-current voltage Vdc, as illustrated in FIG. 4B. If the voltage application is continued with the state described above, the surface potential Vd of the photoreceptor 2 further deviates from the target potential Vdc, and the image quality deteriorates.

In order to deal with this matter, in the present example embodiment, the voltage value of the direct-current voltage to be output to the high-voltage DC generator 14 is dynamically changed such that a center value Vc of the sinusoidal high alternating-current voltage Vac matches the high direct-current voltage Vdc at all times. This matter is described below in detail.

Figure 5:
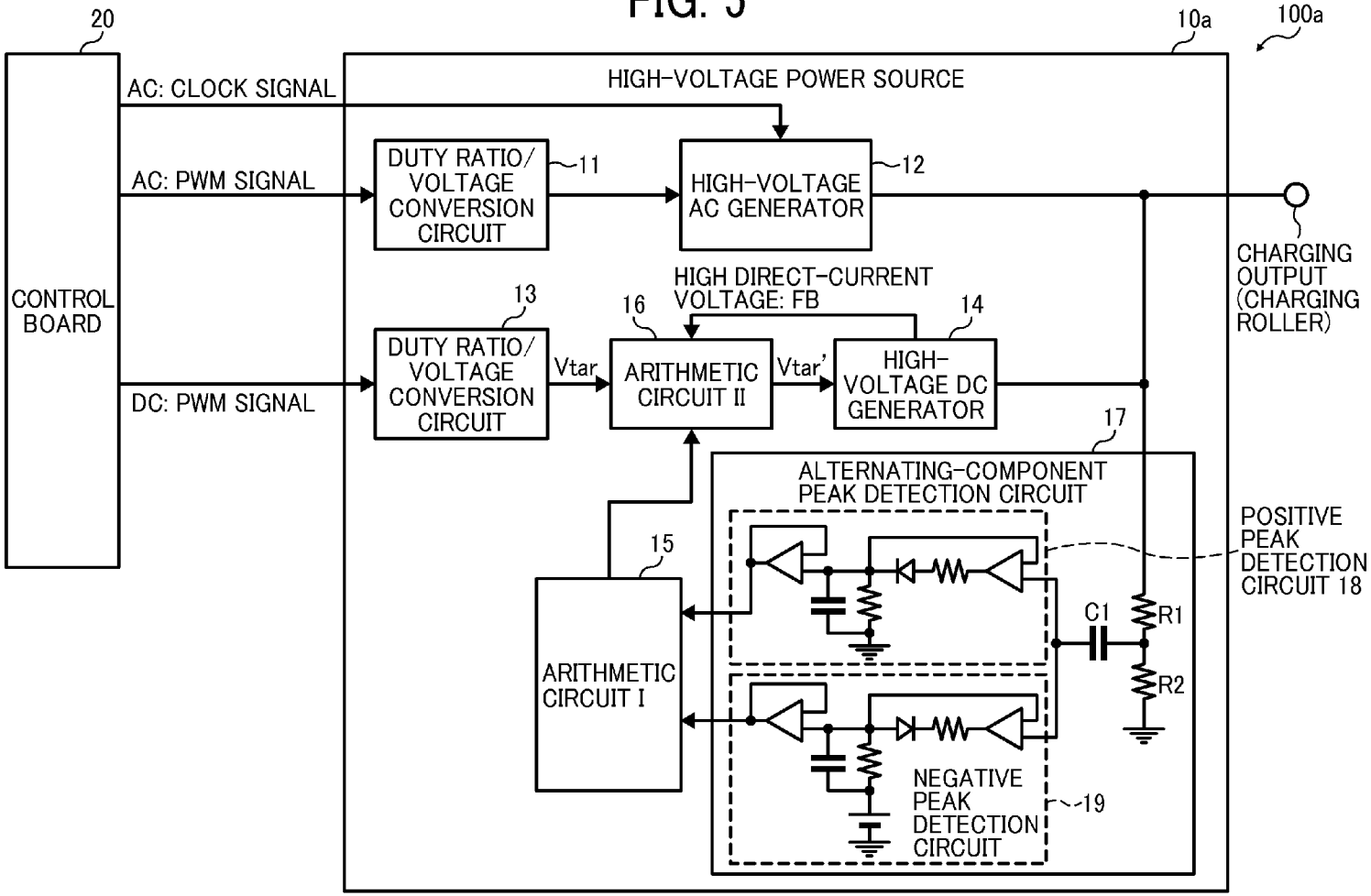
FIG. 5 is a block diagram illustrating the circuitry of a high-voltage power source according to a first example embodiment of the present invention.

FIG. 5 is a block diagram illustrating the circuitry of the high-voltage power source 10 according to the present example embodiment. More detailed configuration of the charging device 100*a* is described with reference to FIG. 5. In the present example embodiment, the high-voltage power source 10 further includes an arithmetic circuit I 15, an arithmetic circuit II 16, and an alternating-component peak detection circuit 17, in addition to the duty ratio/voltage conversion circuit 11, the duty ratio/voltage conversion circuit 13, the high-voltage AC generator 12, and the high-voltage DC generator 14 that are described above with reference to FIG. 2.

As described above with reference to FIG. 2, the AC: PWM signal transmitted from the control board 20 is input to the high-voltage AC generator 12 after being converted into direct-current voltage by the duty ratio/voltage conversion circuit 11. The high-voltage AC generator 12 firstly converts the received direct-current voltage input from the duty ratio/voltage conversion circuit 11 into a sinusoidal alternating-current voltage, and then boosts the sinusoidal alternating-current voltage and outputs the high alternating-current voltage Vac. Note that the high-voltage AC generator 12 receives a clock signal (hereinafter, this clock signal is referred to as "AC clock signal") from the control board 20, and is configured to determine the output frequency of the high alternating-current voltage Vac based on the frequency of the AC clock signal.

The control board 20 transmits the DC: PWM signal to the high-voltage power source 10*a* so as to determine the voltage value Vtar. The DC: PWM signal transmitted from the control board 20 is input to the arithmetic circuit II 16 after being converted by the duty ratio/voltage conversion circuit 13 into direct-current voltage having the voltage value Vtar. The arithmetic circuit II 16 directly transfers the direct-current voltage input from the duty ratio/voltage conversion circuit 13 to the high-voltage DC generator 14 until a certain specified condition, as will be described later, is satisfied. The high-voltage DC generator 14 firstly converts the received direct-current voltage input from the duty ratio/voltage conversion circuit 13 into a sinusoidal alternating-current voltage, and then boosts the sinusoidal alternating-current voltage at a prescribed transformation ratio to generate a high alternating-current voltage, and outputs the high direct-current voltage Vdc obtained by rectifying the generated high alternating-current voltage.

Once the certain specified condition as will be described later is satisfied, the arithmetic circuit II 16 converts the direct-current voltage of the voltage value Vtar input from the duty ratio/voltage conversion circuit 13 into a direct-current voltage of voltage value Vtar', and transmits the obtained direct-current voltage to the high-voltage DC generator 14. In response to this direct-current voltage, the high-voltage DC generator 14 firstly converts the received direct-current voltage of the voltage value Vtar' into a sinusoidal alternating-current voltage, and then boosts the sinusoidal alternating-current voltage at a prescribed transformation ratio to generate a high alternating-current voltage, and outputs the high direct-current voltage Vdc obtained by rectifying the generated high alternating-current voltage.

The high voltage obtained by superposing the high alternating-current voltage Vac on the high direct-current voltage Vdc is input to the alternating-component peak detection circuit 17. The high voltage input to the alternating-component peak detection circuit 17 is divided by a voltage divider, and the direct-current components are removed from the divided high voltage by C1. As a result, only the alternating-current components of the voltage are input to a positive peak detection circuit 18 and a negative peak detection circuit 19 of the alternating-component peak detection circuit 17.

In response to the alternating-current components of the voltage, the positive peak detection circuit 18 detects a positive voltage peak Vp+ of the alternating-current components, and the negative peak detection circuit 19 detects a negative voltage peak Vp− of the alternating-current components. The detected positive voltage peak Vp+ and negative voltage peak Vp− are input to the arithmetic circuit I 15.

The arithmetic circuit I 15 subtracts the absolute value of the negative voltage peak Vp− from the absolute value of the positive voltage peak Vp+, and calculates a voltage value Vg by multiplying the value obtained by the above subtraction by a coefficient α (α is a positive real number smaller than one). Then, the arithmetic circuit I 15 transmits a direct-current voltage having the voltage value Vg to the arithmetic circuit II 16. The voltage value Vg is calculated by using the following formula (1).

[Formula 1]

$$Vg=(|Vp+|-|Vp-|)\times\alpha \quad (1)$$

The coefficient α in the formula (1) is set such that the voltage value Vg becomes smaller than the voltage value Vtar (i.e., the direct-current voltage determined by the DC: PWM signal) in view of the estimated amount of deviation of the center value Vc and the division ratio of the alternating-component peak detection circuit 17.

Assuming that the voltage value of the high direct-current voltage Vdc generated by the high-voltage DC generator 14 from the direct-current voltage of the voltage value Vtar is Vdc_i, the voltage value Vg becomes zero when the voltage value Vdc_i matches the center value Vc of the sinusoidal high alternating-current voltage Vac. When the voltage value Vdc_i deviates from the center value Vc, the voltage value Vg fluctuates according to the amount of deviation between the voltage value Vdc_i and the center value Vc. In other words, the voltage value Vg has a positive value when the center value Vc deviates from the voltage value Vdc_i in the positive direction, and the voltage value Vg has a negative value when the center value Vc deviates from the voltage value Vdc_i in the negative direction.

Once the direct-current voltage having the voltage value Vg is input from the arithmetic circuit I 15, the arithmetic circuit II 16 calculates a voltage value Vtar' by subtracting the voltage value Vg from the voltage value Vtar of the direct-current voltage input from the duty ratio/voltage conversion circuit 13, and transmits the direct-current voltage having the voltage value Vtar' to the high-voltage DC generator 14. The voltage value Vtar' is calculated by using the following formula (2).

[Formula 2]

$$Vtar'=Vtar-Vg \quad (2)$$

The high-voltage DC generator 14 generates a high direct-current voltage Vdc based on the direct-current voltage input from the arithmetic circuit II 16 (i.e., the voltage value Vtar'), and transmits the generated high direct-current voltage Vdc.

When the center value Vc of the sinusoidal high alternating-current voltage Vac deviates from the voltage value Vdc_i in the positive direction due to the electric charge remaining on the surface of the photoreceptor 2, the voltage value Vtar' deviates from the voltage value Vtar in the negative direction. The high-voltage DC generator 14 in a subsequent stage outputs the high direct-current voltage Vdc having a voltage value Vdc_m that deviates from the voltage value Vdc_i in the negative direction. As the high direct-current voltage Vdc (having the voltage value Vdc_m) is superposed on the sinusoidal high alternating-current voltage Vac, the center value Vc of the sinusoidal high alternating-current voltage Vac deviates in the negative direction. As a result, the positive voltage peak Vp+ and the negative voltage peak Vp− output from the alternating-component peak detection circuit 17 are updated, and the voltage value Vg that the arithmetic circuit I 15 outputs is also updated accordingly.

As the cycle described above is repeated, the difference between the absolute value of the positive voltage peak Vp+ and the absolute value of the negative voltage peak Vp−, which are output from the alternating-component peak detection circuit 17, gets close to zero, and eventually, the absolute value of the positive voltage peak Vp+ becomes equal to the absolute value of the negative voltage peak Vp− (i.e., Vg=0). Accordingly, the center value Vc of the sinusoidal high alternating-current voltage Vac matches the voltage value Vdc_i as desired.

According to the present example embodiment, even if the alternating waveform of the sinusoidal high alternating-current voltage Vac is unevenly distorted due to the electric charge remaining on the surface of the photoreceptor 2, the center value Vc of the sinusoidal high alternating-current voltage Vac unfailingly becomes equal to the voltage value Vdc_i as originally desired. As a result, the surface potential Vd of the photoreceptor 2 unfailingly reaches the voltage value Vdc_i as desired. Note that it is desired that the coefficient α in the formula (1) be appropriately set such that the duration of time it takes for the convergence of Vg=0 will be sufficiently short and the control will not be unstable due to overshoots.

The functions of the high-voltage power source 10*a* have been described as above. Next, the processes performed by the arithmetic circuit I 15 and the arithmetic circuit II 16 in the high-voltage power source 10*a* are described in detail.

Figure 6:
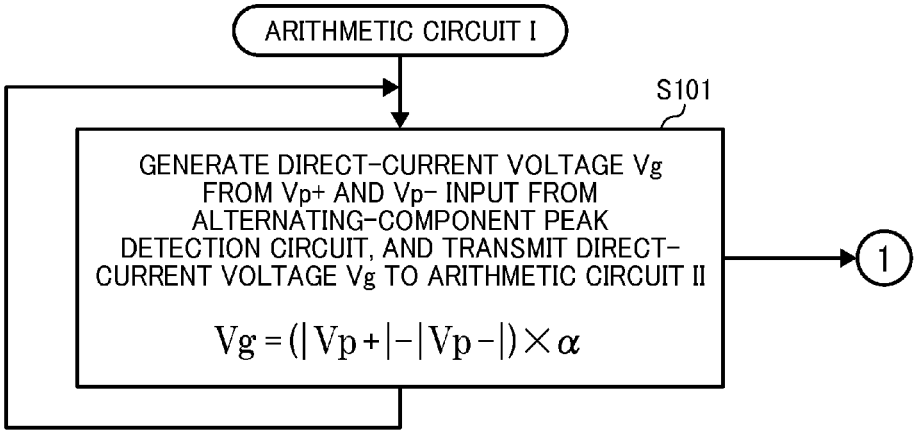
FIG. 6 is a flowchart illustrating the processes performed an arithmetic circuit I of a high-voltage power source according to a first example embodiment of the present invention.

FIG. 6 is a flowchart illustrating the processes performed by the arithmetic circuit I 15 according to the present example embodiment of the present invention. In the present example embodiment, upon receiving the positive and negative voltage peaks Vp+ and Vp− of an alternating waveform from the alternating-component peak detection circuit 17, the arithmetic circuit I 15 subtracts the absolute value of the negative voltage peak Vp− from the absolute value of the positive voltage peak Vp+ and calculates a voltage value Vg by multiplying the value obtained by the above subtraction by a coefficient α (α is a positive real number smaller than 1), and then the arithmetic circuit I 15 transmits a direct-current voltage having the voltage value Vg to the arithmetic circuit II 16 (step S101). The arithmetic circuit 115 repeats step 101.

Figure 7:
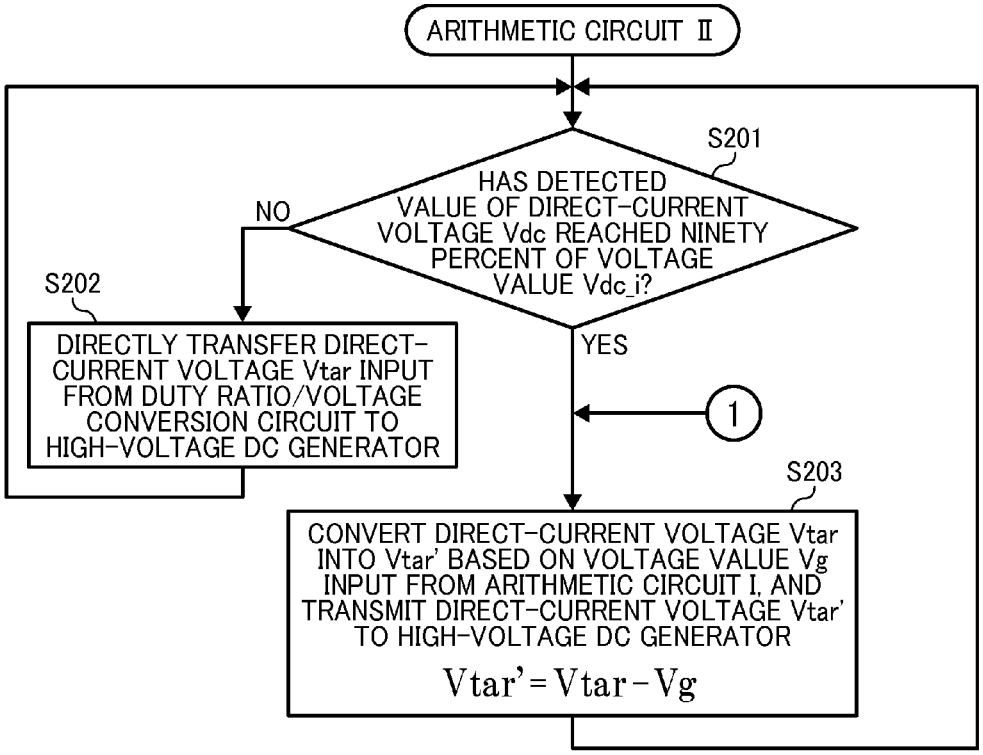
FIG. 7 is a flowchart illustrating the processes performed an arithmetic circuit II of a high-voltage power source according to a first example embodiment of the present invention.

FIG. 7 is a flowchart illustrating the processes performed by the arithmetic circuit II 16 according to the present example embodiment of the present invention. As illustrated in FIG. 5, in the present example embodiment, the direct-current voltage Vdc generated by the high-voltage DC generator 14 is fed back to the arithmetic circuit II 16. The arithmetic circuit II 16 determines whether or not the detected value of the high direct-current voltage Vdc reaches ninety percent of the voltage value Vdc_i (i.e., the voltage value of the high direct-current voltage Vdc generated by the high-voltage DC generator 14 from the direct-current voltage of the voltage value Vtar) (step S201).

While the detected value of the high direct-current voltage Vdc does not reach ninety percent of the voltage value Vdc_i ("No" in step S201), the arithmetic circuit II 16 directly transfers the direct-current voltage input from the duty ratio/voltage conversion circuit 13 (i.e., the voltage value Vtar) to the high-voltage DC generator 14 (step S202).

When the detected value of the high direct-current voltage Vdc reaches ninety percent of the voltage value Vdc_i ("Yes" in step S201), the arithmetic circuit II 16 transmits the direct-current voltage having the voltage value Vtar' to the high-voltage DC generator 14 based on the voltage value Vg input from the arithmetic circuit I 15 (step S203). After that, the process returns to step S201, and the procedure described above is repeated.

The high alternating-current voltage Vac and the high direct-current voltage Vdc, each of which is generated and output as in the procedure described above, are superposed within the high-voltage power source 10*a*, and are output to the charging roller 3.

In the procedure described above, the arithmetic circuit II 16 directly transfers the direct-current voltage input from the duty ratio/voltage conversion circuit 13 (i.e., the voltage value Vtar) to the high-voltage DC generator 14 until the detected value of the high direct-current voltage Vdc reaches ninety percent of the voltage value Vdc_i. A reason for this configuration is described as follows. If the direct-current voltage having the voltage value Vtar' is transmitted to the high-voltage DC generator 14 when a high direct-current voltage or a high alternating-current voltage is rising, the length of time required for the high direct-current voltage to rise may be affected. For this reason, the voltage value of the direct-current voltage is changed from Vtar to Vtar' after the high direct-current voltage has sufficiently risen. Note that the threshold is not limited to "ninety percent", but may be set to any value as appropriate.

Figure 8:
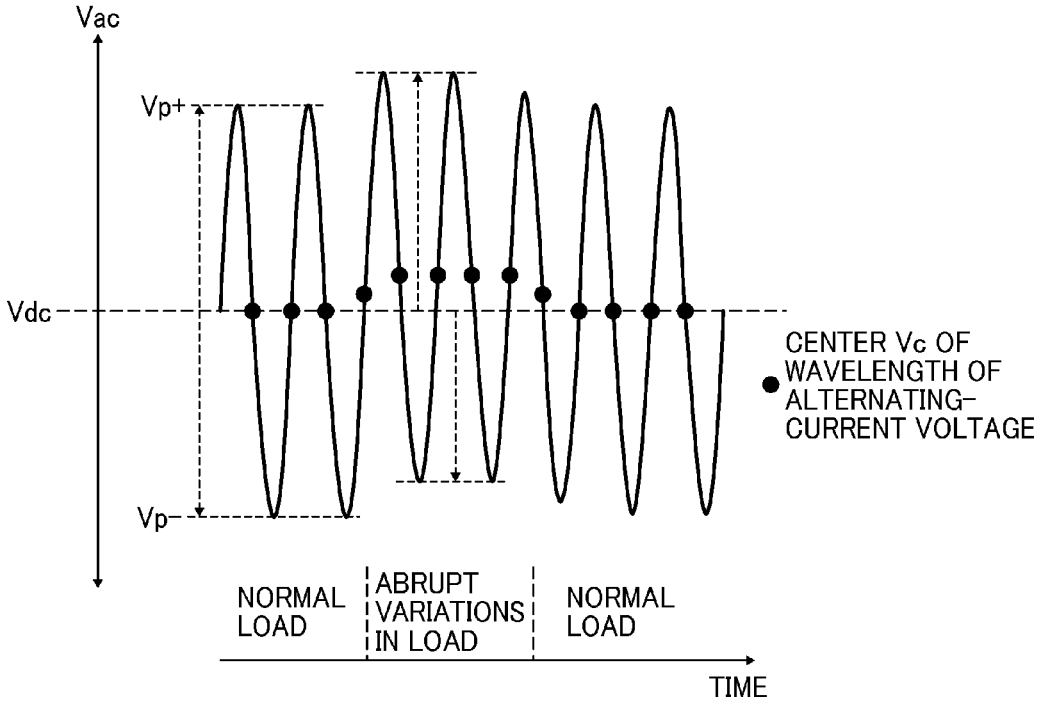
FIG. 8 illustrates abrupt variations of a center value of sinusoidal high alternating-current voltage within a short period of time, according to a first example embodiment of the present invention.

In the example embodiment described above, the configuration has been described in which the voltage value of direct-current voltage to be output to the high-voltage DC generator 14 is dynamically changed for the purpose of adjusting the surface potential Vd of the photoreceptor 2 to a desired value Vdc_i. FIG. 8 illustrates abrupt variations of the center value of sinusoidal high alternating-current voltage within a short period of time, according to the present example embodiment of the present invention. In cases where the center value Vc of the sinusoidal high alternating-current voltage Vac abruptly fluctuates in a short period of time as illustrated in FIG. 8, it is desired that the peak values (i.e., the positive voltage peak Vp+ and the negative voltage peak Vp−) for which the abrupt variations of the center value Vc are reflected in realtime be transmitted to the arithmetic circuit I 15.

In the second example embodiment of the present invention, a configuration is adopted in which the peak values (i.e., the positive voltage peak Vp+ and the negative voltage peak Vp−) detected by the alternating-component peak detection circuit 17 are updated for every cycle of the transmission of alternating-current voltage and the resultant updated values are transmitted to the arithmetic circuit I 15. This configuration is described below in detail.

Second Embodiment

Figure 9:
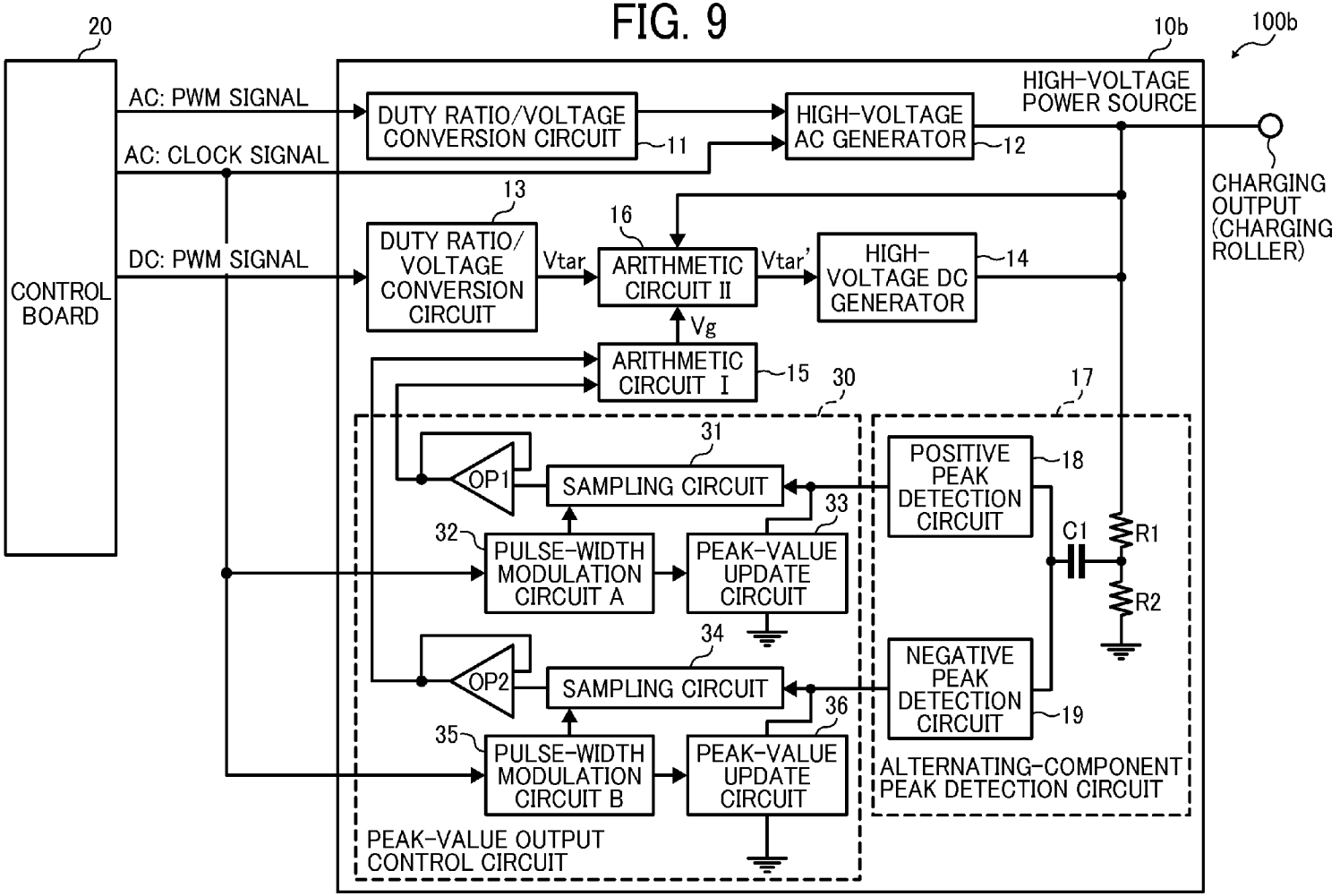
FIG. 9 is a block diagram illustrating the circuitry of a charging device according to a second example embodiment of the present invention.

FIG. 9 is a block diagram illustrating the circuitry of a charging device 100*b* according to the second example embodiment of the present invention. In FIG. 9, like reference signs are given to elements similar to those of the charging device 100*a* according to the first example embodiment described above. In the following description, matters common to the first example embodiment are omitted where appropriate, and differences from the first example embodiment will mainly be described.

As illustrated in FIG. 9, a high-voltage power source 10*b* of the charging device 100*b* according to the present example embodiment includes a peak-value output control circuit 30 subsequent to the alternating-component peak detection circuit 17 of the first example embodiment. The peak-value output control circuit 30 includes sampling circuits 31 and 34, pulse-width modulation circuits 32 and 35 (A and B), and peak-value update circuits 33 and 36, subsequent to the positive peak detection circuit 18 and the negative peak detection circuit 19, respectively.

Firstly, the functions of the pulse-width modulation circuits A and B are described. In a similar manner to the first example embodiment described above, in the present example embodiment, an AC clock signal is input from the control board 20 to the high-voltage AC generator 12, and the high-voltage AC generator 12 determines the output frequency of the high alternating-current voltage Vac based on the AC clock signal.

In the present example embodiment, the same AC clock signal is input to the pulse-width modulation circuits A and B, and the pulse-width modulation circuits A and B generate a pulse signal based on the AC clock signal input from the control board 20. The generation mechanism of such a pulse signal is described below with reference to FIG. 10.

Figure 10A:
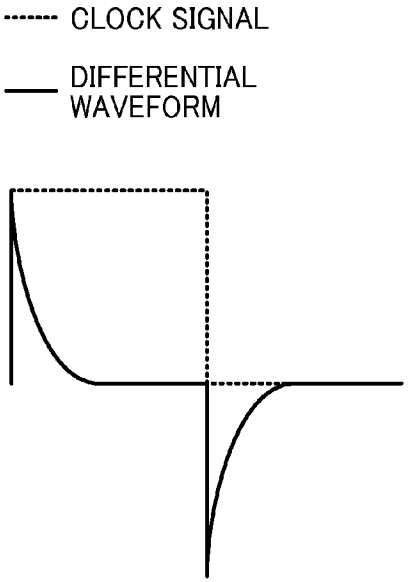
FIGS. 10A, 10B, and 10C illustrate the procedure followed by each pulse-width modulation circuit for generating a pulse signal, according to an example embodiment of the present invention.
Figure 10B:
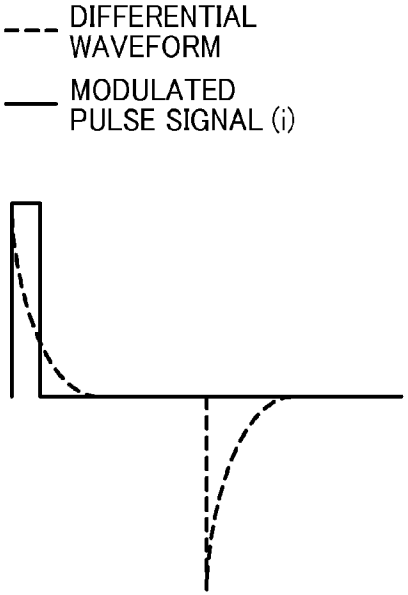
Figure 10C:
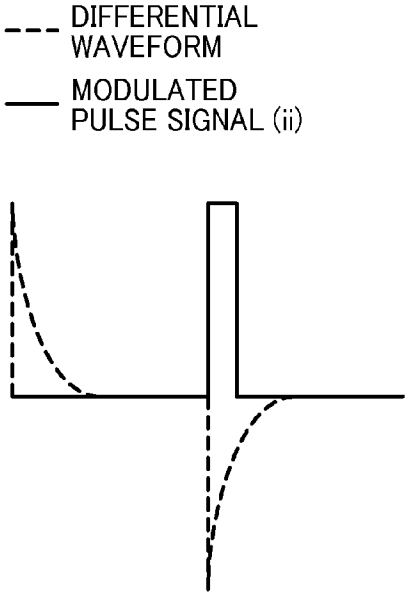

FIGS. 10A, 10B, and 10C illustrate the procedure followed by each of the pulse-width modulation circuits A and B for generating a pulse signal, according to the present example embodiment of the present invention. Once an AC clock signal is input to the pulse-width modulation circuits A and B, the pulse-width modulation circuits A and B perform differentiation on the AC clock signal (i.e., a pulse signal with the duty ratio of 50%) indicated by dotted lines in FIG. 10A, and generate a differential waveform as indicated by the bold line in FIG. 10A.

Next, the pulse-width modulation circuits A and B use a comparator to compare the differential waveform with a prescribed reference voltage. By so doing, the pulse-width modulation circuits A and B generate a modulated pulse signal (i) at a rising edge of the differential waveform as indicated by the bold line in FIG. 10B, and generate a modulated pulse signal (ii) at a falling edge of the differential waveform as indicated by the bold line in FIG. 10C. Note that in FIGS. 10B and 10C, an original differential waveform is indicated by broken lines. As illustrated in FIGS. 10B and 10C, the modulated pulse signals (i) and (ii) have pulse waveforms whose duty ratios are smaller than that of the original AC clock signal.

The pulse-width modulation circuits A and B output the generated pulse signals (i) and (ii) to the sampling circuit 31 and the pulse-width modulation circuit 33, and to the sampling circuit 34 and the peak-value update circuit 36, respectively.

Figure 11A:
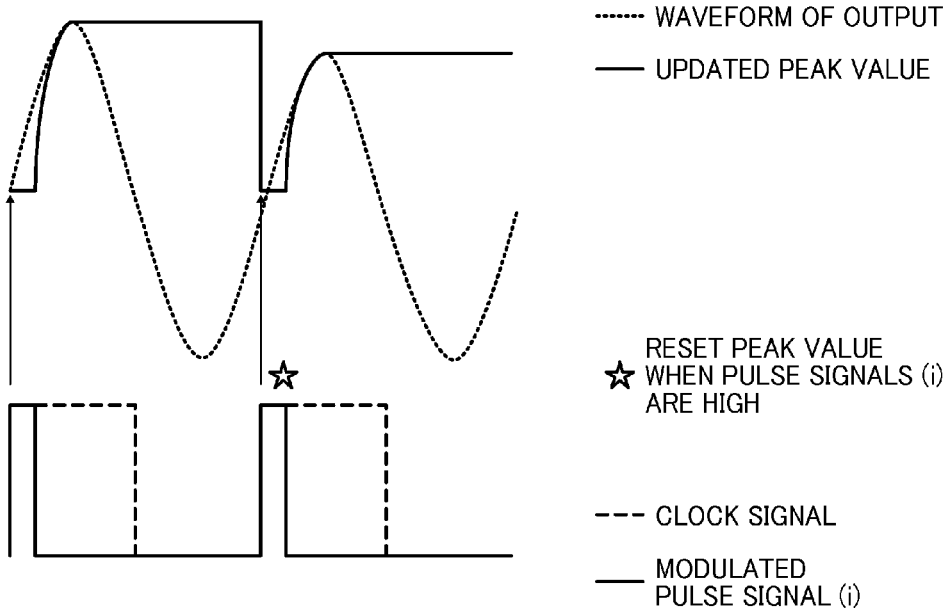
FIGS. 11A and 11B illustrate the operation of a peak-value update circuit and a sampling circuit, according to an example embodiment of the present invention.
Figure 11B:
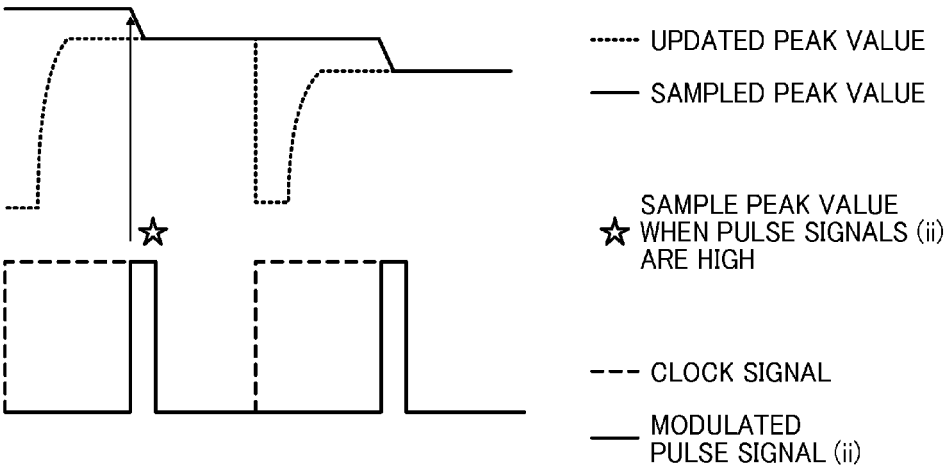

Next, the functions of the sampling circuits 31 and 34 and the peak-value update circuits 33 and 36 are described. FIGS. 11A and 11B illustrate the operation of the peak-value update circuits 33 and 36 and the sampling circuits 31 and 34, according to the present example embodiment of the present invention. The positive peak detection circuit 18 and the negative peak detection circuit 19 detect the positive voltage peak Vp+ and the negative voltage peak Vp− by passing an electric current in one direction to store an electric charge in a capacitor. In order to update the positive voltage peak Vp+ and the negative voltage peak Vp−, an electric charge needs to be stored again upon resetting the electric charge stored in the capacitor. In this respect, as illustrated in FIG. 11A, the peak-value update circuits 33 and 36 are configured to discharge the capacitors of the positive peak detection circuit 18 and the negative peak detection circuit 19 when the pulse signals (i) input from the pulse-width modulation circuits A and B are high. Due to this configuration, the positive peak detection circuit 18 and the negative peak detection circuit 19 repeat electric charge and discharge in synchronization with pulse signals (i) input from the pulse-width modulation circuits A and B.

As illustrated in FIG. 11B, the sampling circuits 31 and 34 are configured to sample the output of the positive peak detection circuit 18 and the negative peak detection circuit 19, which repeat electric charge and discharge, when the pulse signals (ii) input from the pulse-width modulation circuits A and B are high. Then, the sampling circuits 31 and 34 transmit the values of the sampled positive voltage peak Vp+ and negative voltage peak Vp− to the arithmetic circuit I 15.

Due to the cooperation among the pulse-width modulation circuits 32 and 35 (A and B), the peak-value update circuits 33 and 36, and sampling circuits 31 and 34, the positive voltage peak Vp+ and the negative voltage peak Vp− detected by the positive peak detection circuit 18 and the negative peak detection circuit 19 are updated for every cycle of the output frequency of the high alternating-current voltage Vac and are transmitted to the arithmetic circuit I 15.

In FIGS. 11A and 11B, only the upper peak value in the waveform of the alternating-current voltage is described. Note that in the present example embodiment, the capacitor is reset and the positive voltage peak Vp+ and the negative voltage peak Vp− are sampled in a similar manner for the lower peak value in the waveform of the alternating-current voltage. More specifically, in the detection of the lower peak value in the waveform of the alternating-current voltage, the peak-value update circuits 33 and 36 discharge the capacitors of the positive peak detection circuit 18 and the negative peak detection circuit 19 when the pulse signals (ii) are high, and the sampling circuits 31 and 34 sample the output from the positive peak detection circuit 18 and the negative peak detection circuit 19 when the pulse signals (i) are high.

In the example embodiment described above, the positive voltage peak Vp+ and the negative voltage peak Vp− are updated for every cycle of the transmission of alternating-current voltage, and the resultant updated values are transmitted to the arithmetic circuit I 15. In order to realize this configuration, the pulse width of the pulse signals generated by the pulse-width modulation circuits 32 and 35 (A and B) needs to satisfy a certain prescribed condition. Such a condition for the pulse width of a pulse signal in the present example embodiment is described with reference to FIGS. 12A and 12B.

Figure 12A:
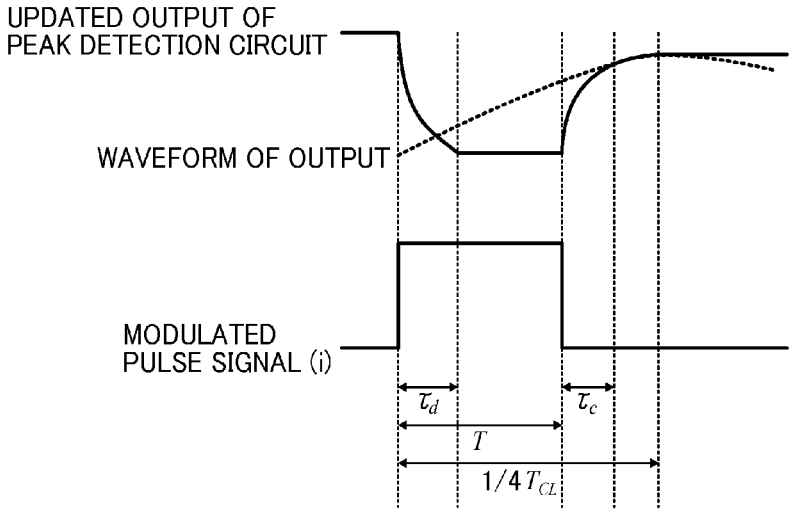
FIGS. 12A and 12B illustrate conditions for pulse width of a pulse signal generated by a pulse-width modulation circuit, according to an example embodiment of the present invention.
Figure 12B:
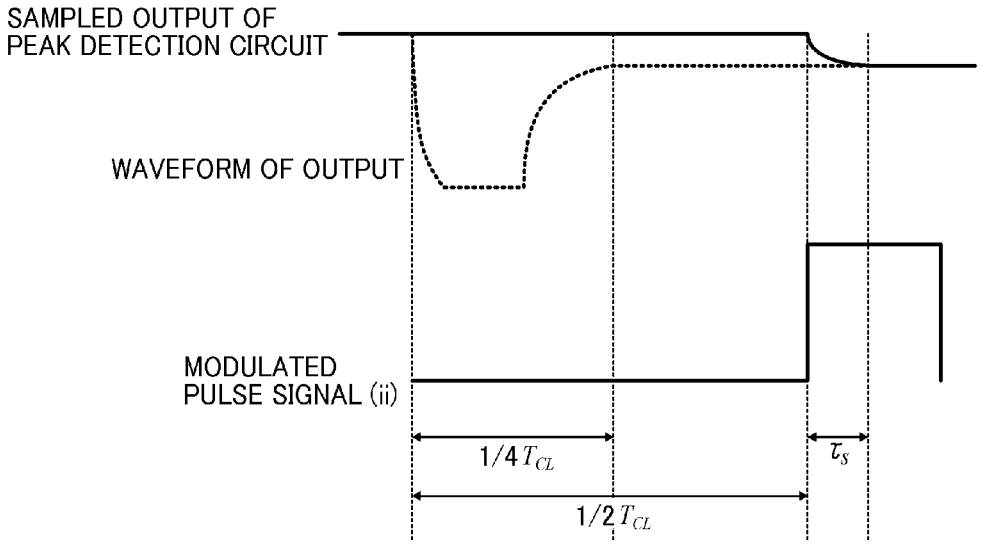

FIGS. 12A and 12B illustrate conditions for the pulse width of a pulse signal generated by the pulse-width modulation circuits A and B, according to the present example embodiment of the present invention. Firstly, in view of the update of a peak value, as illustrated in FIG. 12A, the modulated pulse signal (i) needs to be maintained at a high level until a time τd for discharging the capacitors of the positive peak detection circuit 18 and the negative peak detection circuit 19 (i.e., the length of time required to completely discharge the capacitors) passes. Moreover, a time $\tau_c$ for charging the capacitors of the positive peak detection circuit 18 and the negative peak detection circuit 19 is necessary after the modulated pulse signal (i) becomes low and before the period corresponding to ¼ $T_{CL}$ ($T_{CL}$: cycle of AC clock signal) passes and the output level of alternating-current voltage reaches a peak. Accordingly, a condition for the pulse width T of the modulated pulse signal (i) is expressed by the formula (3) below.

[Formula 3]

$$\tau_d < T < \tfrac{1}{4} T_{CL} - \tau_c \tag{3}$$

Secondly, in view of the sampling process of a peak value, as illustrated in FIG. 12B, the modulated pulse signal (ii) needs to be maintained at a high level for a period of time longer than a period TS that starts when the period corresponding to ½ $T_{CL}$ ($T_{CL}$: cycle of AC clock signal) has passed and finishes when the sampling processes terminate. Accordingly, a condition for the pulse width T of the modulated pulse signal (ii) is expressed by the formula (4) below.

[Formula 4]

$$\tau_S < T \tag{4}$$

In FIGS. 12A and 12B, only the upper peak value in the waveform of the alternating-current voltage is described. In the lower half of the waveform of the alternating-current voltage, a peak value is updated when the pulse signal (ii) is high, and a sampling process is performed when the pulse signal (i) is high. Accordingly, the pulse widths of the modulated pulse signals (i) and (ii) need to satisfy both the formulas (1) and (2).

The condition for the pulse width of a pulse signal in the present example embodiment has been described. In the present example embodiment, the component values of a resistance or capacitor used to differentiate an AC clock signal and a reference voltage used for a comparator are controlled such that the pulse-width modulation circuits 32 and 35 (A and B) generate a pulse signal satisfying both the formulas (1) and (2).

The functions of the high-voltage power source 10*b* according to the second example embodiment have been described as above. Next, the processes performed by the pulse-width modulation circuits 32 and 35 (A and B) in the high-voltage power source 10*b* are described in detail.

Figure 13:
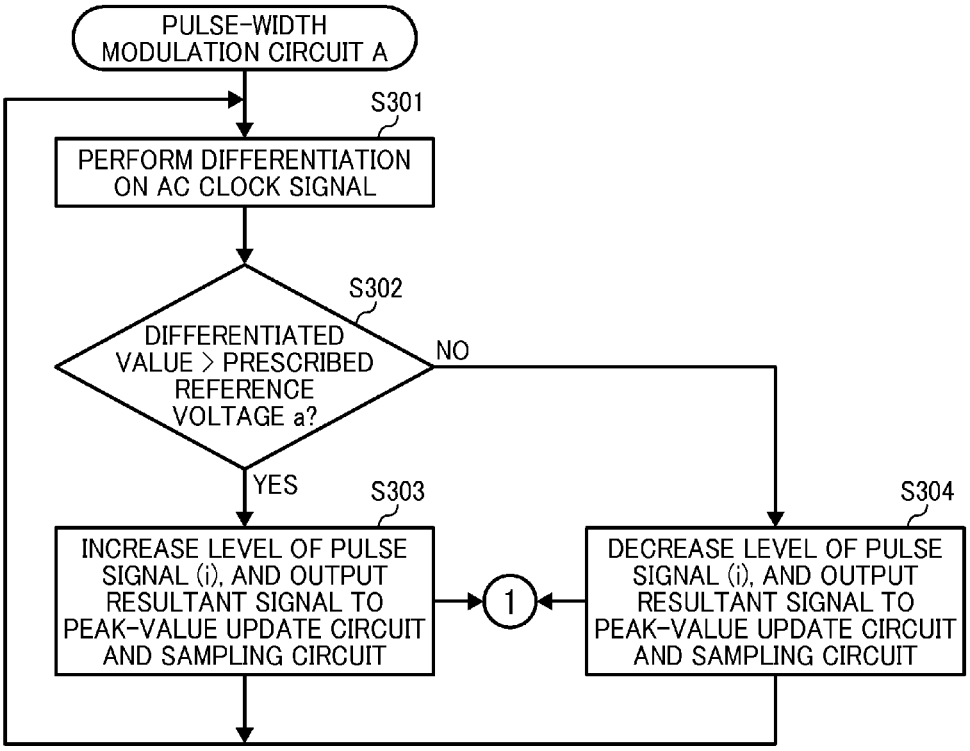
FIG. 13 is a flowchart illustrating the processes performed by a pulse-width modulation circuit according to an example embodiment of the present invention.

FIG. 13 is a flowchart illustrating the processes performed by the pulse-width modulation circuit 32 (A) according to the present example embodiment of the present invention. The pulse-width modulation circuit 32 (A) performs differentiation on the AC clock signal input from the control board 20 (step S301). In the subsequent step S302, the pulse-width modulation circuit 32 (A) uses a comparator to compare the differentiated value with a prescribed reference voltage a.

When the differentiated value is greater than the reference voltage a ("Yes" in step S302), the pulse-width modulation circuit 32 (A) increases the level of the pulse signal (i), and outputs the resultant signal to the peak-value update circuit 33 and the sampling circuit 31 (step S303). On the other hand, when the differentiated value is equal to or less than the reference voltage a ("No" in step S302), the pulse-width modulation circuit 32 (A) decreases the level of the pulse signal (i), and outputs the resultant signal to the peak-value update circuit 33 and the sampling circuit 31 (step S304). The pulse-width modulation circuit 32 (A) repeats the processes described above.

Figure 14:
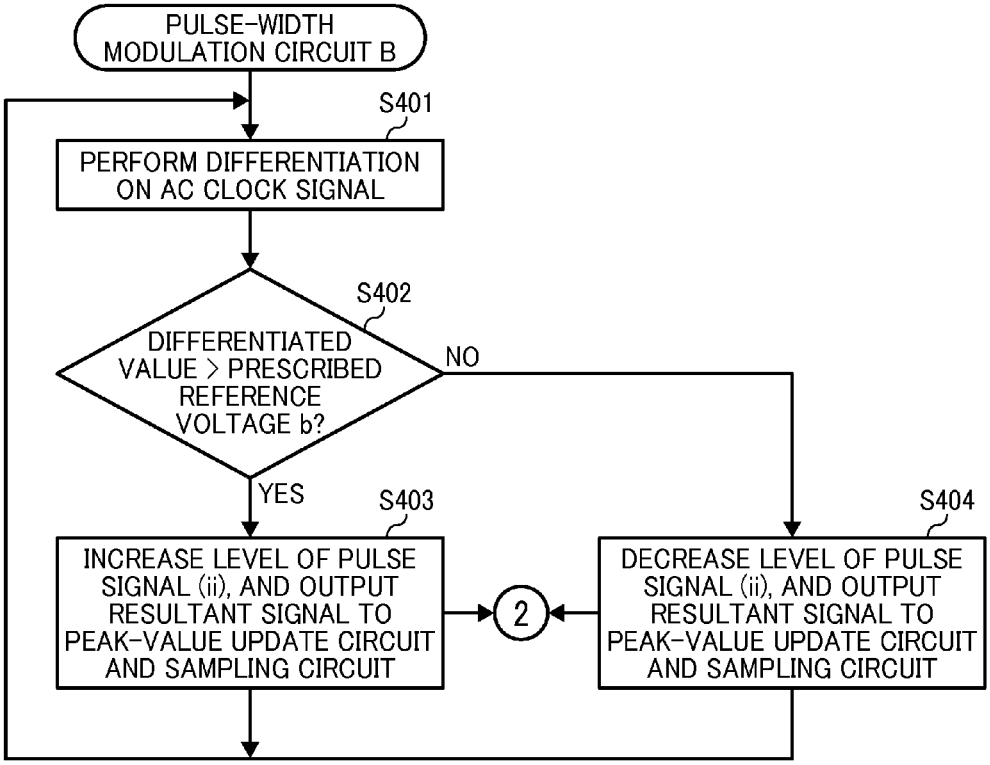
FIG. 14 is a flowchart illustrating the processes performed by a pulse-width modulation circuit according to an example embodiment of the present invention.

FIG. 14 is a flowchart illustrating the processes performed by the pulse-width modulation circuit 35 (B) according to the present example embodiment of the present invention. The pulse-width modulation circuit 35 (B) performs differentiation on the AC clock signal input from the control board 20 (step S401). In the subsequent step S402, the pulse-width modulation circuit 35 (B) uses a comparator to compare the differentiated value with a prescribed reference voltage b.

When the differentiated value is smaller than the reference voltage b ("Yes" in step S402), the pulse-width modulation circuit 35 (B) increases the level of the pulse signal (ii), and outputs the resultant signal to the peak-value update circuit 33 and the sampling circuit 31 (step S403). On the other hand, when the differentiated value is equal to or greater than the reference voltage b ("No" in step S402), the pulse-width modulation circuit 35 (B) decreases the level of the pulse signal (ii), and outputs the resultant signal to the peak-value update circuit 33 and the sampling circuit 31 (step S404). The pulse-width modulation circuit 35 (B) repeats the processes described above.

Figure 15:
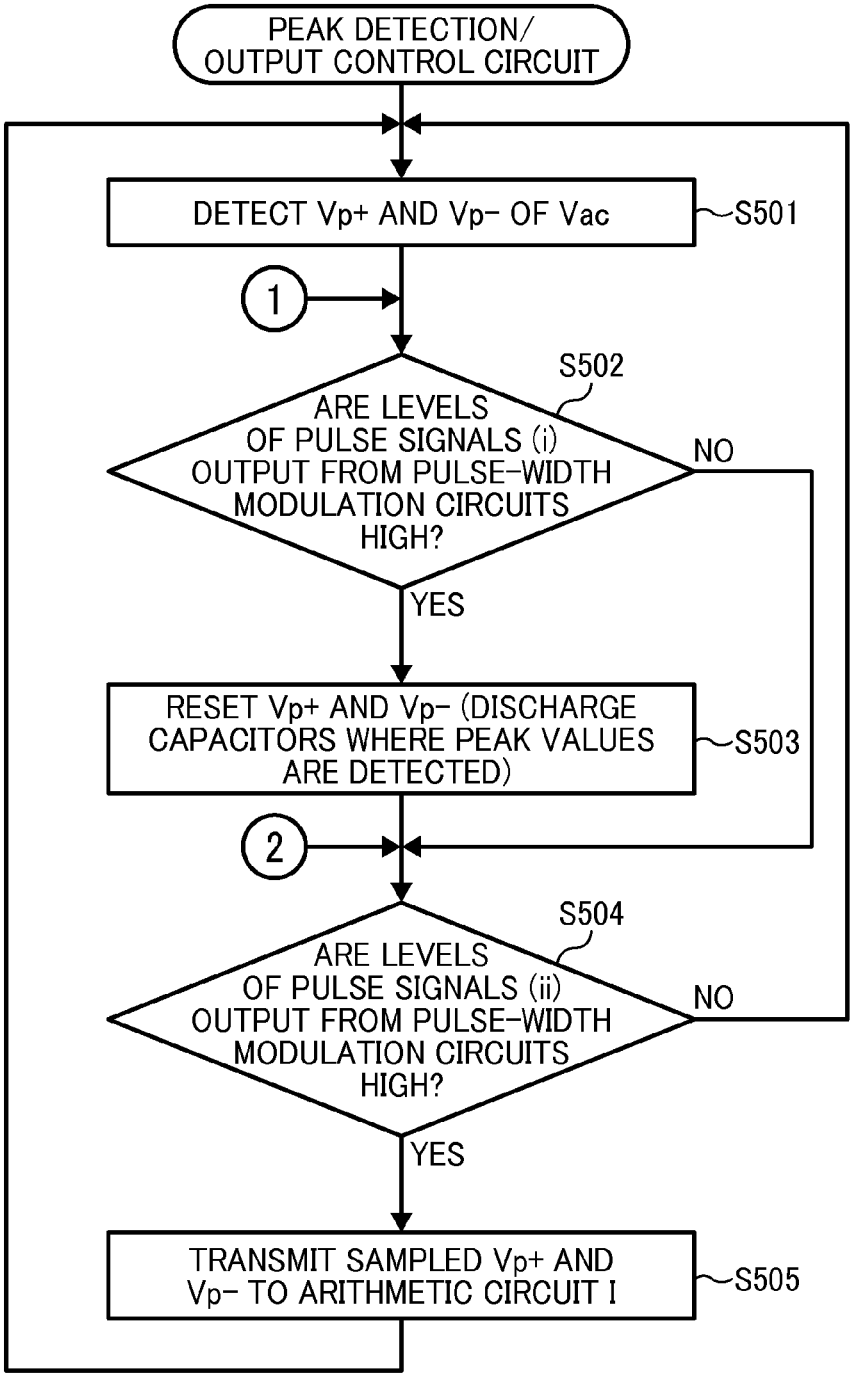
FIG. 15 is a flowchart illustrating the processes performed by a peak-value output control circuit according to an example embodiment of the present invention.

FIG. 15 is a flowchart illustrating the processes performed the peak-value output control circuit 30 according to the present example embodiment of the present invention. Lastly, the processes performed by the alternating-component peak detection circuit 17 (i.e., the positive peak detection circuit 18 and the negative peak detection circuit 19) in cooperation with the peak-value output control circuit 30 are described in detail with reference to the flowchart depicted in FIG. 15.

Firstly, the positive peak detection circuit 18 and the negative peak detection circuit 19 detects the positive voltage peak Vp+ and the negative voltage peak Vp− of the sinusoidal high alternating-current voltage Vac, respectively (step S501). In the subsequent step, the positive peak detection circuit 18 and the negative peak detection circuit 19 determine whether or not the levels of the pulse signals (ii) output from the pulse-width modulation circuits A and B are high (step S502). When the levels of the pulse signals (i) are not high ("No" in step S502), the process directly shifts to step S504. On the other hand, when the levels of the pulse signals (ii) are high ("Yes" in step S502), the positive peak detection circuit 18 and the negative peak detection circuit 19 discharge the capacitors, and then reset the values of the detected positive voltage peak Vp+ and negative voltage peak Vp− (step S503). Then, the process shifts to step S504.

In the subsequent step, the sampling circuits 31 and 34 determine whether or not the levels of the pulse signals (ii) output from the pulse-width modulation circuits A and B are high (step S504). When the levels of the pulse signals (ii) are not high ("No" in step S504), the process directly returns to step S501. On the other hand, when the pulse signals (ii) are high ("Yes" in step S504), the sampling circuits 31 and 34 sample the output of the positive peak detection circuit 18 and the negative peak detection circuit 19, and transmit the values of the sampled positive voltage peak Vp+ and negative voltage peak Vp− to the arithmetic circuit 115 (step S505).

As described above, according to the second example embodiment of the present invention, the peak values (i.e., the positive voltage peak Vp+ and the negative voltage peak Vp−) detected by the positive peak detection circuit 18 and the negative peak detection circuit 19 are updated for every cycle of the output frequency of the high alternating-current voltage Vac, and the resultant updated values are transmitted to the arithmetic circuit I 15. Accordingly, even if the center value Vc of the sinusoidal high alternating-current voltage Vac abruptly fluctuates in a short period of time, the surface potential Vd of the photoreceptor 2 can be maintained at a desired value Vdc_i.

Embodiments of the present invention has been described above, but the present invention is not limited to those embodiments and various applications and modifications may be made without departing from the scope of the invention.

Numerous additional modifications and variations are possible in light of the above teachings. It is therefore to be understood that within the scope of the appended claims, the disclosure of the present invention may be practiced otherwise than as specifically described herein. For example, elements and/or features of different illustrative embodiments may be combined with each other and/or substituted for each other within the scope of this disclosure and appended claims.

What is claimed is:

1. A high-voltage power source comprising:

a high-voltage power source unit configured to apply high voltage obtained by superposing a high alternating-current voltage on a high direct-current voltage to a charging member used to charge a photoreceptor of an image forming apparatus;

an output unit configured to output a first direct-current voltage having a first voltage value according to an externally input pulse-width modulation signal;

a direct-current voltage conversion unit configured to convert the first direct-current voltage into a second direct-current voltage;

a generation unit configured to boost the second direct-current voltage to generate the high direct-current voltage;

a peak value detection unit configured to detect a positive peak value and a negative peak value from an alternating-current component of the high direct-current voltage; and a voltage difference output unit configured to calculate a third voltage value by multiplying a difference between an absolute value of the positive peak value and an absolute value of the negative peak value by a coefficient α, and output a third direct-current voltage having the third voltage value to the direct-current voltage conversion unit, the coefficient α being a positive real number smaller than one, wherein the direct-current voltage conversion unit outputs the second direct-current voltage having a voltage value calculated by subtracting the third voltage value from the first voltage value.

2. The high-voltage power source according to claim 1, further comprising: a peak-value output control unit configured to update the positive and negative peak values detected by the peak value detection unit for every cycle of an output frequency of the high alternating-current voltage, and output the updated positive peak value and negative peak value to the voltage difference output unit.

3. The high-voltage power source according to claim 2, wherein the peak-value output control unit comprises:

a peak value update unit configured to update the positive and negative peak values detected by the peak value detection unit;

a sampling unit configured to sample the positive and negative peak values updated by the peak value update unit; and a pulse-width modulation unit configured to generate a pulse signal for determining a timing when the peak value update unit and the sampling unit are to operate, based on a clock signal used to determine an output frequency of the high alternating-current voltage.

4. The high-voltage power source according to claim 3, wherein the pulse-width modulation unit compares a rising edge of a signal obtained by differentiating the clock signal with a prescribed reference voltage to generate a first pulse signal, and compares a falling edge of the obtained signal with a prescribed reference voltage to generate a second pulse signal, the peak value update unit discharges a capacitor of the peak value detection unit to update the positive and negative peak values when the first pulse signal sent from the pulse-width modulation unit is high, and the sampling unit samples an output of the peak value detection unit when the second pulse signal sent from the pulse-width modulation unit is high.

5. The high-voltage power source according to claim 1, wherein the direct-current voltage conversion unit converts the first direct-current voltage into the second direct-current voltage when a voltage value of the generated high direct-current voltage reaches ninety percent of a voltage value of the high direct-current voltage generated from the first direct-current voltage.

6. The high-voltage power source according to claim 1, wherein the charging member is a charging roller contacting with or being adjacent to the photoreceptor.

7. A charging device, comprising the high-voltage power source according to claim 1.

8. An image forming apparatus, comprising the high-voltage power source of claim 1.

9. A method of supplying high-voltage power, the method comprising:

applying high voltage obtained by superposing a high alternating-current voltage on a high direct-current voltage to a charging member used to charge a photoreceptor of an image forming apparatus;

outputting a first direct-current voltage having a first voltage value according to an externally input pulse-width modulation signal;

converting the first direct-current voltage into a second direct-current voltage;

boosting the second direct-current voltage to generate the high direct-current voltage;

detecting a positive peak value and a negative peak value from an alternating-current component of the high direct-current voltage;

calculating a third voltage value by multiplying a difference between an absolute value of the positive peak value and an absolute value of the negative peak value by a coefficient α, the coefficient α being a positive real number smaller than one; and outputting a third direct-current voltage having the third voltage value to the converting, wherein the converting includes outputting the second direct-current voltage having a voltage value calculated by subtracting the third voltage value from the first voltage value.

10. The method according to claim 9, further comprising:

updating the positive and negative peak values detected by the detecting for every cycle of an output frequency of the high alternating-current voltage; and outputting the updated positive peak value and negative peak value to the calculating.

11. The method according to claim 10, wherein the updating comprises:

updating the positive and negative peak values detected by the detecting;

sampling the updated positive and negative peak values; and generating a pulse signal for determining a timing for the updating and sampling, based on a clock signal used to determine an output frequency of the high alternating-current voltage.

12. The method according to claim 11, wherein the generating includes comparing a rising edge of a signal obtained by differentiating the clock signal with a prescribed reference voltage to generate a first pulse signal, and comparing a falling edge of the obtained signal with a prescribed reference voltage to generate a second pulse signal, the updating includes discharging a capacitor used by the detecting to update the positive and negative peak values when the first pulse signal sent from the pulse-width modulation unit is high, and the sampling includes sampling an output of the peak value detection unit when the second pulse signal sent from the generating.

13. The method according to claim 9, wherein the converting includes converting the first direct-current voltage into the second direct-current voltage when a voltage value of the generated high direct-current voltage reaches ninety percent of a voltage value of the high direct-current voltage generated from the first direct-current voltage.

14. The method according to claim 9, wherein the charging member is a charging roller contacting with or being adjacent to the photoreceptor.

* * * * *